US009182173B2

(12) United States Patent
Ogawa et al.

(10) Patent No.: US 9,182,173 B2
(45) Date of Patent: Nov. 10, 2015

(54) ARC FURNACE

(71) Applicants: Masato Ogawa, Aichi (JP); Kunio Matsuo, Aichi (JP); Noriyuki Tomita, Aichi (JP); Akihiro Nagatani, Aichi (JP)

(72) Inventors: Masato Ogawa, Aichi (JP); Kunio Matsuo, Aichi (JP); Noriyuki Tomita, Aichi (JP); Akihiro Nagatani, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 0 days.

(21) Appl. No.: 14/467,541

(22) Filed: Aug. 25, 2014

(65) Prior Publication Data

US 2015/0063400 A1 Mar. 5, 2015

(30) Foreign Application Priority Data

Aug. 31, 2013 (JP) ..... 2013-180757

(51) Int. Cl.

| | |
|---|---|
| ***F27D 27/00*** | (2010.01) |
| ***F27D 3/00*** | (2006.01) |
| ***F27B 14/02*** | (2006.01) |
| ***F27B 14/08*** | (2006.01) |
| ***F27B 14/06*** | (2006.01) |
| *F27B 14/00* | (2006.01) |

(52) U.S. Cl.

CPC ..... *F27B 14/02* (2013.01); *F27B 14/06* (2013.01); *F27B 14/08* (2013.01); *F27B 2014/002* (2013.01); *F27B 2014/0831* (2013.01); *F27B 2014/0887* (2013.01)

(58) Field of Classification Search

CPC ..... F27B 14/02; F27B 14/06; F27B 14/08; F27B 2014/0831; F27B 2014/0887; F27B 2014/0002

USPC ..... 373/60, 71, 72, 84, 143, 83, 115, 79, 373/85, 86; 266/240, 242, 163; 264/30; 432/247

See application file for complete search history.

(56) References Cited

U.S. PATENT DOCUMENTS

| | | | | |
|---|---|---|---|---|
| 1,378,972 A * | 5/1921 | Moore | ..... | 373/62 |
| 2,625,385 A * | 1/1953 | Clifford | ..... | 432/138 |
| 2,665,319 A * | 1/1954 | Ludwig | ..... | 373/146 |
| 2,686,961 A * | 8/1954 | Tonnes | ..... | 373/72 |

FOREIGN PATENT DOCUMENTS

| | | |
|---|---|---|
| JP | 60-122886 | 7/1985 |

* cited by examiner

*Primary Examiner* — Hung D Nguyen
(74) *Attorney, Agent, or Firm* — Greenblum & Bernstein, P.L.C.

(57) ABSTRACT

Provided is an arc furnace, including: a furnace body having a bottomed cylindrical shape; a furnace lid that openably closes an opening of the furnace body; an electrode that is provided at the furnace lid and melts a metal material supplied into the furnace body by electric discharge; a tilting floor that is tiltable within a plane substantially perpendicular to the tilting floor; and a rotation mechanism that is provided on the tilting floor inward from an outer circumference of the furnace body to support a bottom wall of the furnace body, and rotates the furnace body around a cylinder axis thereof.

3 Claims, 8 Drawing Sheets

ARC FURNACE

FIELD OF THE INVENTION

The present invention relates to an arc furnace, and particularly relates to an arc furnace that enables uniform melting.

BACKGROUND OF THE INVENTION

In an arc furnace, in particular, a three-phase arc furnace, there has been the problem that the metal material in the furnace is not melted uniformly. That is, while melting of the metal material quickly advances in the hot spot near each of the three electrodes, the metal material tends to remain unmelted in the cold spot distant from each of the electrodes. Therefore, there have been the problems that electric power more than necessary to melt the metal material in the cold spots is required, and that the furnace wall lining is damaged due to excessive supply of electric power in the hot spot. Consequently, Patent Document 1 proposes the arc furnace that enables uniform melting by making a bottomed cylindrical furnace body rotatable around a cylinder axis thereof, and replacing the hot spots and the cold spots.

[Patent Document 1] JP-A-S60-122886

SUMMARY OF THE INVENTION

However, in the above described conventional arc furnace, there has been the problem that the entire arc furnace increases in size to outside since the rack and the pinion, the speed reducer, the electric motor and the like for rotating the furnace body are provided at an outside of the circumference of the furnace body. Further, the conventional arc furnace also has the problem that the operation efficiency is low because the furnace is incapable of tilting pouring.

Consequently, the present invention is to solve the problems as above, and has an object to provide an arc furnace that realizes improvement in operation efficiency by avoiding increase in size of an entire furnace, and enabling tilting pouring, while enabling uniform melting of a material.

In order to attain the above described object, the present invention provides an arc furnace, including: a furnace body (1) having a bottomed cylindrical shape; a furnace lid (2) that openably closes an opening of the furnace body (1); an electrode (3) that is provided at the furnace lid (2) and melts a metal material supplied into the furnace body (1) by electric discharge; a tilting floor (5) that is tiltable within a plane substantially perpendicular to the tilting floor; and a rotation mechanism (4) that is provided on the tilting floor (5) inward from an outer circumference of the furnace body (1) to support a bottom wall (11) of the furnace body (1), and rotates the furnace body (1) around a cylinder axis thereof.

The arc furnace of the present invention has the structure in which the rotation mechanism is provided on the tilting floor and the furnace body is mounted thereon. Therefore, tilting pouring is enabled, and operation efficiency is improved. Further, since the rotation mechanism is provided on the tilting floor inward from the outer circumference of the furnace body, nothing protrudes outward of the furnace body, and the size of the entire furnace is prevented from increasing outward. The furnace body is rotated around the cylinder axis by the rotation mechanism, whereby the positions of the hot spots and the cold spots are replaced with one another, and uniform melting of the material is achieved.

Moreover, in the arc furnace of the present invention, it is preferable that the rotation mechanism (4) includes: a ring body (41) that is provided at an outer circumferential portion of the bottom wall (11) of the furnace body (1), and has a connecting portion (42) formed on an inner circumferential surface of the furnace body; a bearing member (8) that is provided at a necessary part of a bottom surface of the ring body (41) to support the ring body (41) rotatably around a center thereof; and a drive mechanism (92, 93, 95) that is provided on the tilting floor (5) inward of the ring body (41) and has an output portion connected to the connecting portion (42).

According to the present invention, the furnace body is rotatably supported by the bearing member with the compact structure, and the ring body with the connecting portion formed on the inner circumferential surface of the furnace body is connected to the drive mechanism and is rotationally driven, whereby the furnace body can be reliably rotated.

Furthermore, it is preferable that stopper mechanisms (961, 963, 964) are provided at the ring body (41) side and the tilting floor (5) side, and are fitted to each other to restrict rotation of the ring body (41) when the ring body (41) is in a predetermined rotation position.

According to the present invention, rotation of the furnace body is restricted by the stopper mechanisms, for example, in a state in which the furnace body directly confronts the tapping yard, whereby a reliable tapping operation is enabled.

The reference signs in the parentheses show the correspondence with the specific means described in embodiments that will be described later.

As described above, according to the arc furnace of the present invention, improvement in the operation efficiency can be realized by avoiding increase in size of the entire furnace and enabling tilting pouring while enabling uniform melting of a material.

DETAILED DESCRIPTION OF THE INVENTION

Note that embodiments that will be described hereinafter are only examples, and various design improvements that are made by a person skilled in the art within the range without departing from the gist of the present invention are also included in the range of the present invention.

First Embodiment

Figure 1:
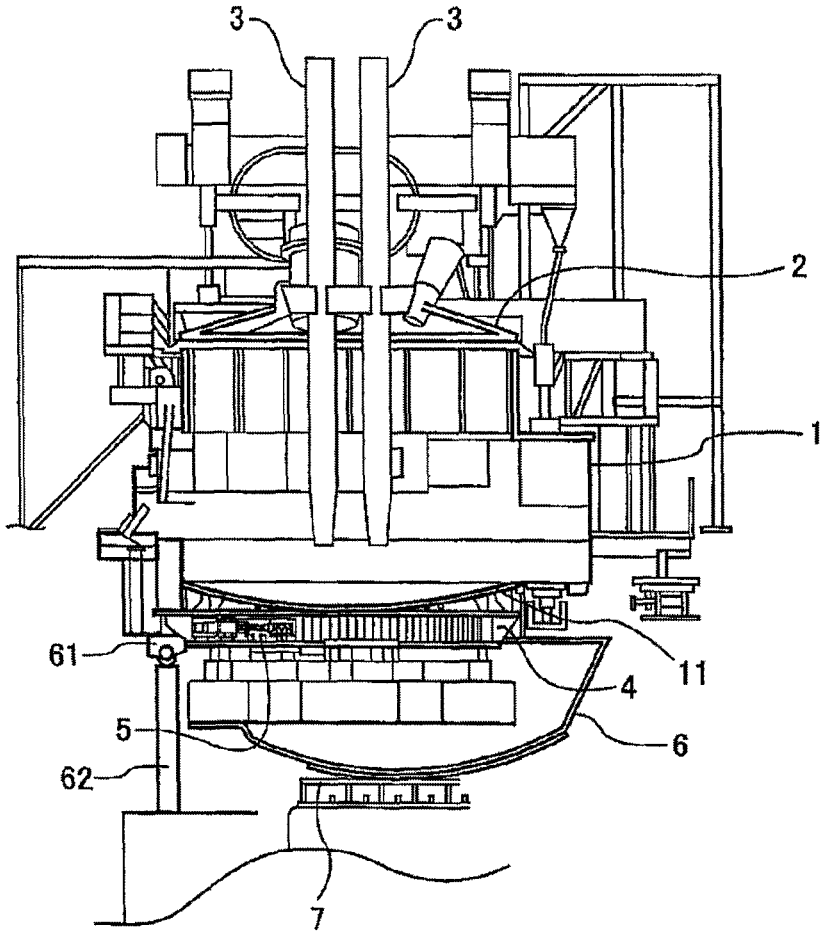
FIG. 1 is an overall vertical sectional view of an arc furnace in a first embodiment of the present invention.

FIG. 1 shows a sectional view of an arc furnace including a structure of the present invention. The arc furnace includes a furnace body 1 having a bottomed cylindrical shape that opens upward. An opening thereof is closed by a furnace lid 2 that is separated upward and capable of being turned and opened. Three (only two are illustrated) electrodes 3 are penetrated through the furnace lid 2 and inserted into the furnace body 1 located under the furnace lid 2. A bottom wall 11 of the furnace body 1 bends downward in a convex shape, and the bottom wall 11 is supported by a rotation mechanism 4, which will be described later. The rotation mechanism 4 is provided on a tilting floor 5. The tilting floor 5 configures a top surface of a tilting body 6. The tilting body 6 has a bottom surface bent downward in a convex shape, and a vertex thereof is located on a horizontal base stand 7.

An upper end of a drive cylinder 62 that is placed in a vertical direction is rotatably connected to a bracket 61 that is provided at one end of the tilting body 6. A lower end of the drive cylinder 62 is rotatably connected to a bracket that is installed on a floor surface (not illustrated in FIG. 1). Thereby, when the drive cylinder 62 is extended upward, the tilting body 6 rolls on the base stand 7, and the tilting floor 5 inclines downward in a right direction in FIG. 1. With this, the furnace body 1 which is supported on the tilting floor 5 also inclines downward in a right direction in FIG. 1, and tapping of molten steel in the furnace body 1 is enabled. When the drive cylinder 62 is contracted, the tilting floor 5 inclines downward in a left direction in FIG. 1, whereby discharge of slag can be performed.

Figure 2:
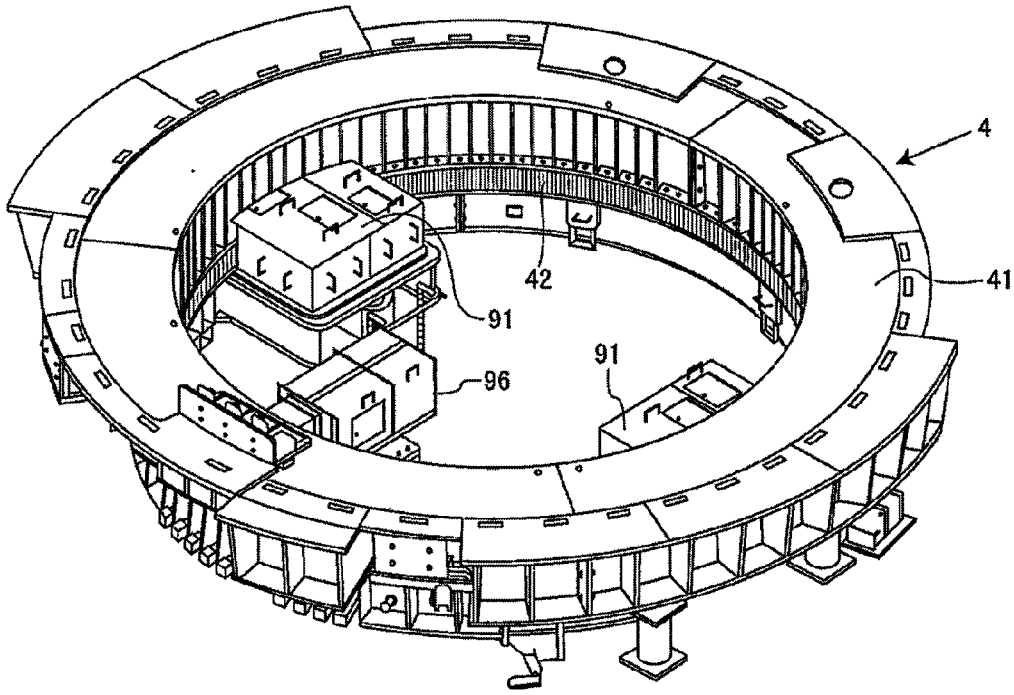
FIG. 2 is an overall perspective view of a rotation mechanism.
Figure 3:
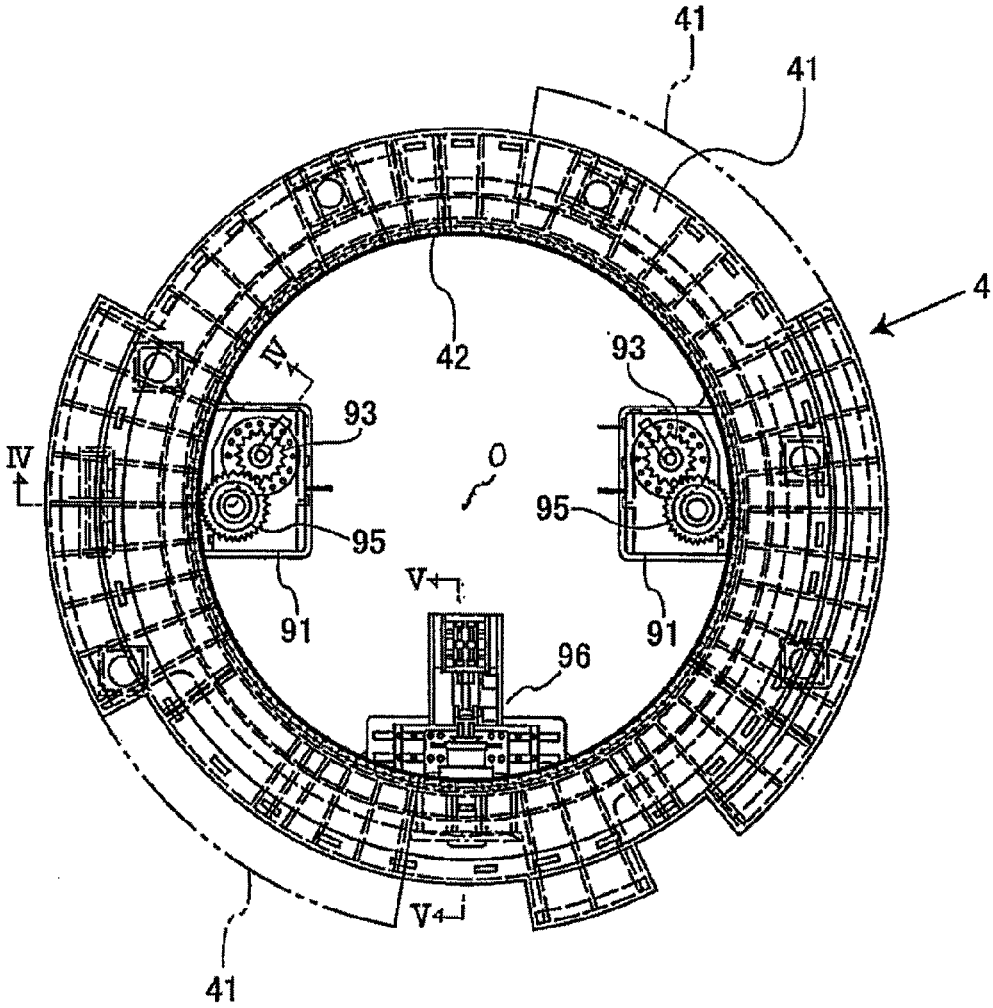
FIG. 3 is an overall plan view of the rotation mechanism.

FIG. 2 shows an overall perspective view of the rotation mechanism 4. FIG. 3 shows an overall plan view of the rotation mechanism 4. The rotation mechanism 4 has a circular-ring-shaped support frame 41 that includes a number of upright walls, and is a ring body. The furnace body 1 (FIG. 1) is placed on and fixed to a top surface of the support frame 41. A ring-shaped gear body 42 is fixed to a whole circumference on a bottom surface of an inner circumferential portion of the support frame 41 (see FIG. 4). Note that the gear body 42 does not always have to be provided on the whole circumference, but may be provided only at a necessary part.

In the gear body 42, tooth profiles that are connecting portions are formed on the whole circumference of the inner circumference. Further, an outer circumference intermediate portion of the gear body 42 protrudes outward by forming a rectangular section to configure an inner ring portion 81 of a bearing member 8. An outer ring portion 82 with a U-shaped section is placed to wrap the inner ring portion 81, and a roller bearing 83 is interposed between a concave surface of the outer ring portion 82 and top and bottom surfaces and an outer peripheral edge surface of the inner ring portion 81. The outer ring portion 82 has a bottom surface fixed to a tilting floor 5 (FIG. 1) side. Note that the tooth profiles of the gear body 42 may be formed only at a necessary portion. Further, the connecting portions do not have to be always the tooth profiles of the gear body 42.

By the structure as described above, the support frame 41 is supported by the bearing member 8 to be rotatable in a plane parallel with the tilting floor 5 around a ring center thereof. Thereby, the furnace body 1 (FIG. 1) supported by the rotation mechanism 4 having the circular-ring-shaped support frame 41 is rotatable around a cylinder axis thereof.

Figure 4:
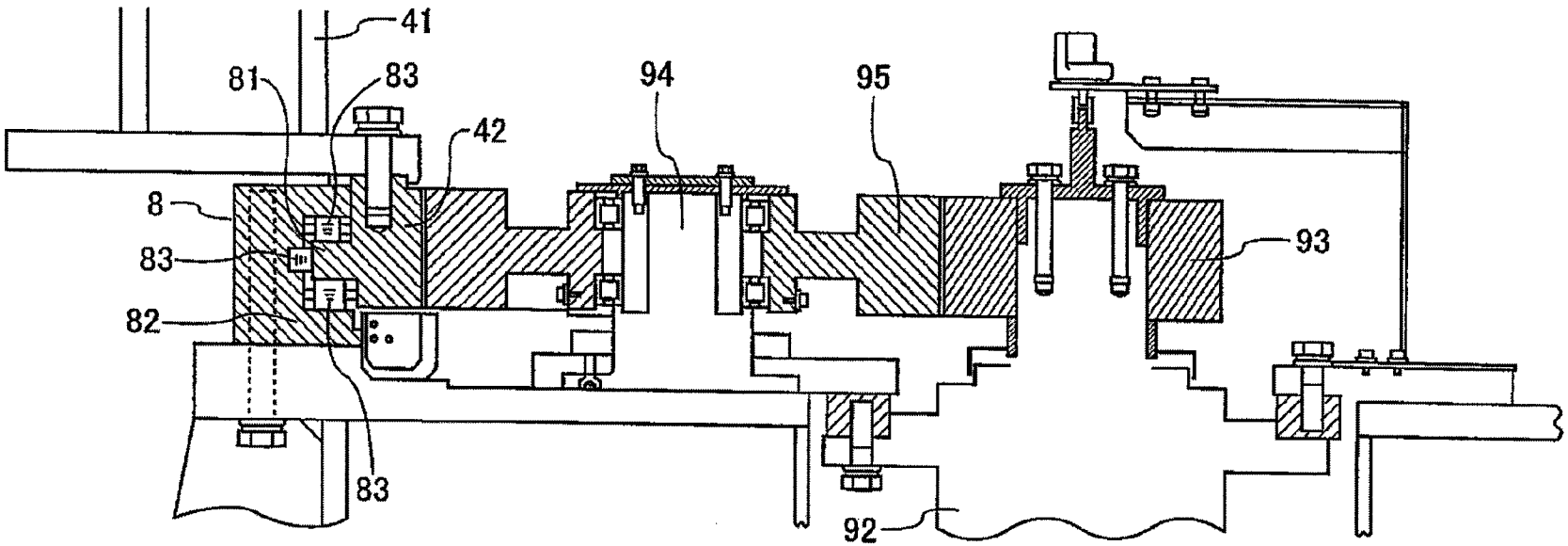
FIG. 4 is a sectional view taken along a line IV-IV of FIG. 3.

Gear boxes 91 (FIG. 3) are provided in radially symmetrical positions on the tilting floor 5 at an inner side of the ring of the support frame 41, and gear bodies are placed inside thereof. FIG. 4 shows the details. In FIG. 4, a hydraulic motor 92 including the drive mechanism, in a vertical posture is provided at the tilting floor 5 side, and a gear body 93 is fitted to an output shaft thereof. The gear body 93 is engaged with a gear body 95 that is rotatably supported by a shaft body 94 vertically provided at the tilting floor 5 side, and the gear body 95 is engaged with the tooth profiles of the above described ring-shaped gear body 42.

Thereby, when the hydraulic motor 92 is rotated in forward and reverse directions, the support frame 41 is rotated in forward and reverse directions via the gear bodies 93, 95 and 42. In the present embodiment, by the hydraulic motor 92, the support frame 41, namely, the furnace body 1 can be rotated in a range (a chain line of FIG. 3) of 50° in a counterclockwise direction from an original position shown in FIG. 3 in which a tapping port of the furnace body 1 directly confronts a tapping yard.

Figure 5:
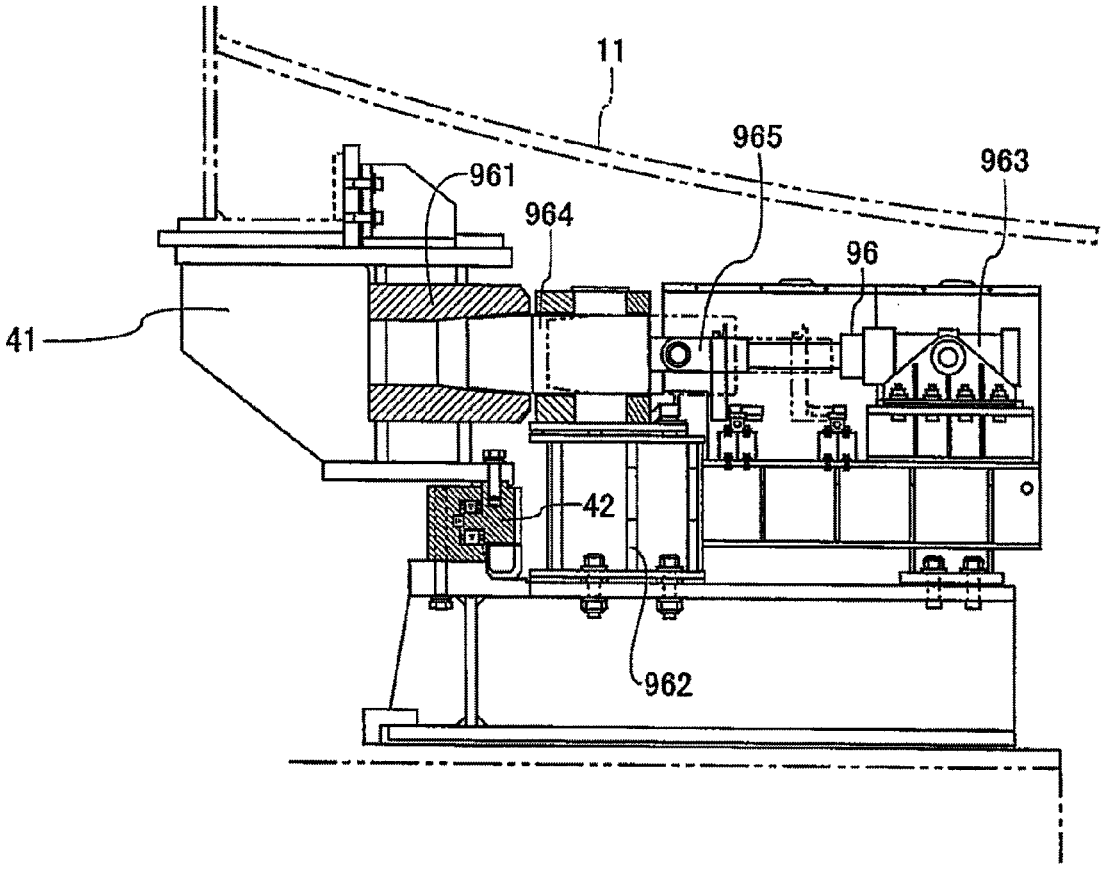
FIG. 5 is a sectional view taken along a line V-V of FIG. 3.

A stopper mechanism 96 is placed in an intermediate position in a circumferential direction of the support frame 41, between both the gear boxes 91. FIG. 5 shows details of the stopper mechanism 96. In FIG. 5, the support frame 41 is provided with a sheath member 961 toward an inside. The sheath member 961 is a cylindrical body, and an inner circumference of a half part thereof at the inner side is formed into a tapered shape that gradually expands inward. At the tilting floor 5 side, a plug member 964 that is linearly advanced and retreated in inward and outward directions by a drive cylinder 963 is provided on a stand 962. The plug member 964 is formed into a circular-column body in which a distal end portion located at an outer side gradually reduces in diameter in a distal end direction, and a rear end of the plug member 964 is connected to a rod 965 of the drive cylinder 963.

When the support frame 41 is in the original position, the sheath member 961 directly confronts the plug member 964, as shown in FIG. 5, whereas when the plug member 964 is advanced by the drive cylinder 963, the plug member 964 advances into the sheath member 961, and the distal end portion in the tapered shape of the plug member 964 is fitted into the half part in the tapered shape of the sheath member 961. Thereby, rotation of the support frame 41, namely, the furnace body 1 is reliably restricted, and tapping tilt or slag discharging tilt of the furnace body 1 by the tilting body 6 can be performed in this state.

Figure 6A:
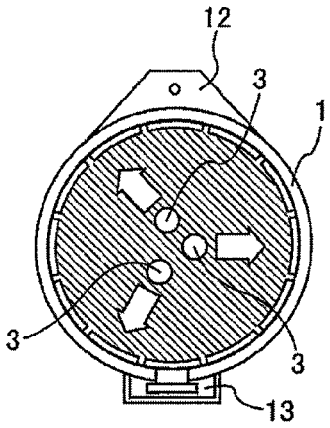
FIGS. 6A to 6F are schematic horizontal sectional views of a furnace body showing operation steps of the arc furnace.
Figure 6B:
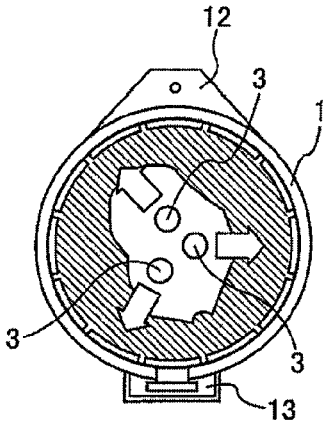
Figure 6C:
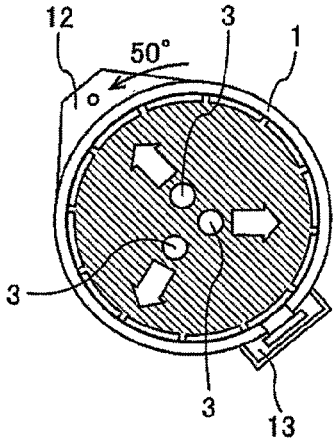
Figure 6D:
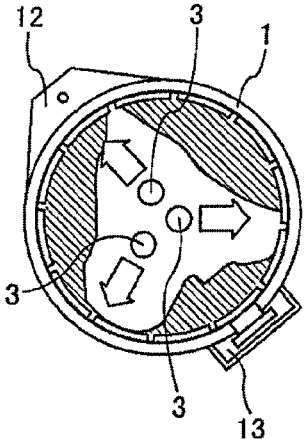
Figure 6E:
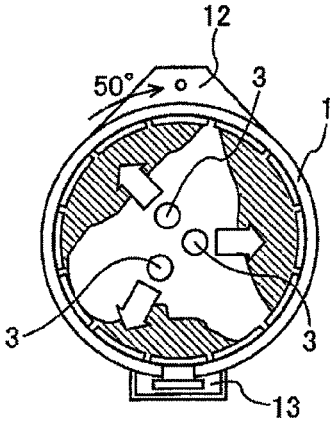

Steps in the case of performing melting of a metal material (scrap) in the arc furnace as above will be described hereinafter with reference to FIGS. 6A to 6F. Note that in FIGS. 6A to 6F, shaded parts in the furnace body 1 show unmelted scrap, and hollow parts show melted scrap. Further, reference sign 12 designates the tapping port, and reference sign 13 designates a slag discharge port. In FIGS. 6A and 6B, each show a first melting time period, in which the scrap in the furnace body 1 is melted by arc discharge (hollow arrows) from the three electrodes 3. In this stage, extreme nonuniformity of melting does not occur yet (FIG. 6B). In FIGS. 6C and 6D, each show a second melting time period, in which after the furnace lid 2 is opened and the furnace body 1 is rotated by 50° from the original position in advance (the black arrow in FIG. 6C), scrap is additionally charged (FIG. 6C).

Figure 6F:
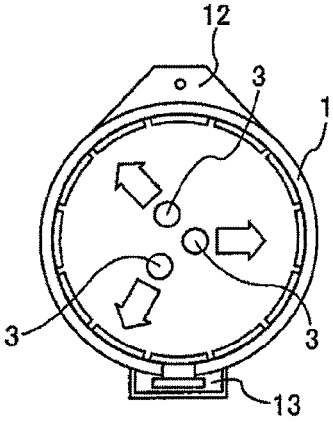

When the furnace lid 2 is closed in the above state and the scrap in the furnace body 1 is melted by arc discharge from the three electrodes 3, hot spots at three spots and cold spots at three spots are alternately generated in the circumferential direction of the furnace body 1 and the scrap is melted nonuniformly (FIG. 6D). Thus, in the next oxidation heat increase time period, the furnace lid is separated upward, the furnace body 1 is returned to the original position again to rotate (the black arrow of FIG. 6E), and unmelted scrap is moved to the hot spots. When the furnace lid 2 is closed in this state and discharge from the electrodes 3 is restarted, electric power is effectively supplied to the unmelted scrap, quick melting advances, and the entire scrap is melted uniformly (FIG. 6F).

Second Embodiment

Figure 7:
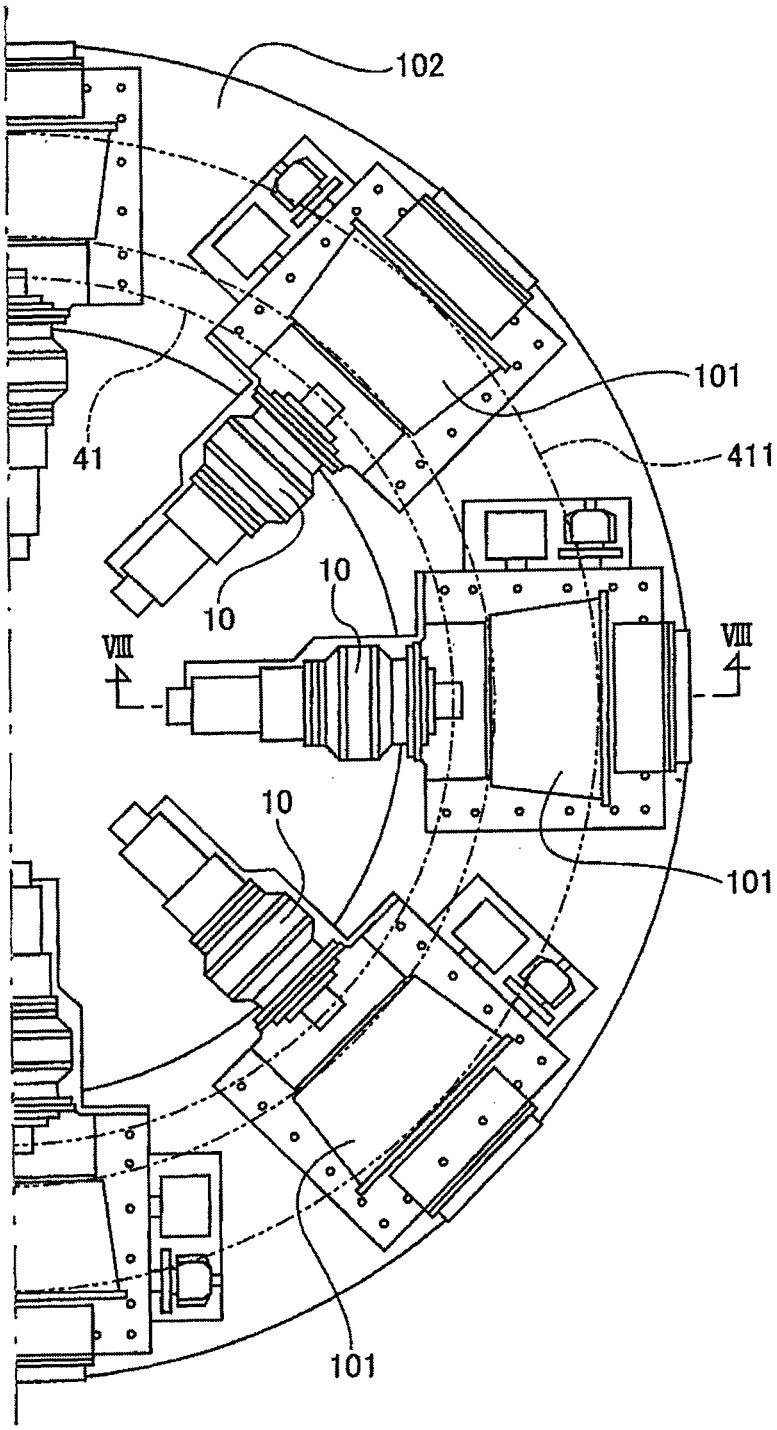
FIG. 7 is a plan view of a half part of a rotation mechanism in a second embodiment of the present invention.
Figure 8:
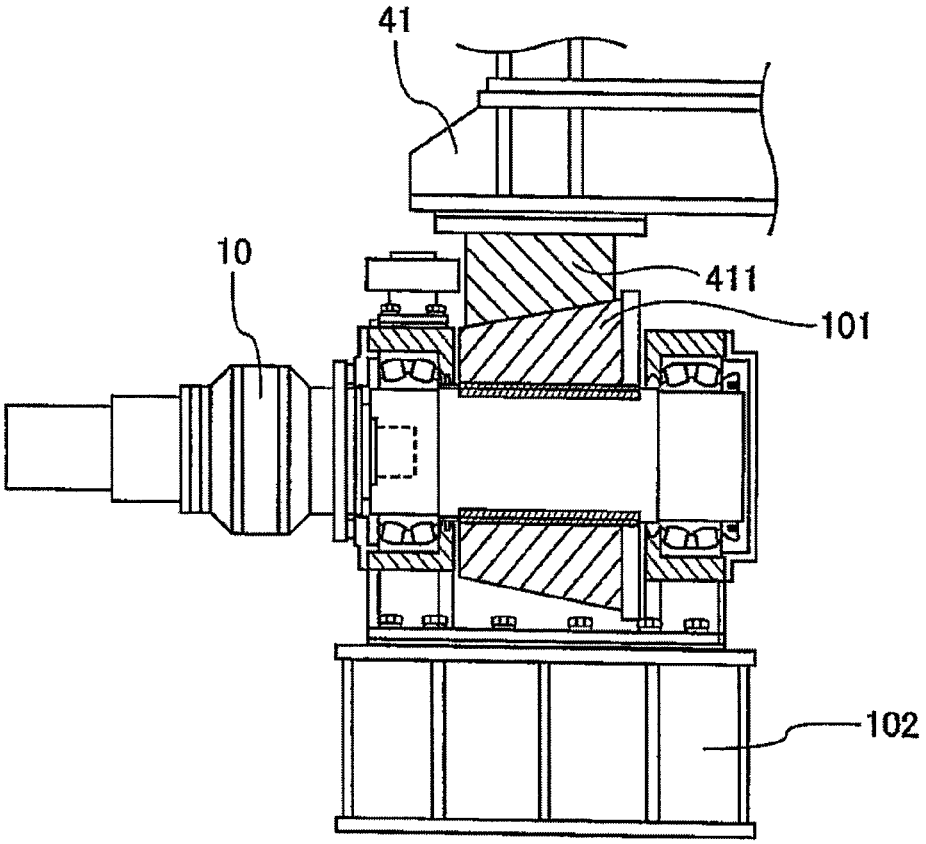
FIG. 8 is a sectional view taken along a line VIII-VIII of FIG. 7.

FIGS. 7 and 8 show another example of the rotation mechanism in the present invention. In the present embodiment, a plurality of hydraulic motors 10 and drive rollers 101 fixed to output shafts thereof are provided at intervals on a stand 102 provided on the tilting floor 5 side below the support frame 41 along a whole circumference (FIG. 7 shows only a half of the circumference) of the ring of the support frame 41. The drive roller 101 has a tapered shape that expands in diameter toward an outer side (a right side in FIG. 8) of the support frame 41, and a ring-shaped spacer body 411 that is provided on a whole circumference of the bottom surface of the inner circumferential portion of the support frame 41 is placed on the drive rollers 101.

The spacer body 411 has a bottom surface formed into an inclined surface along the outer circumference of the drive rollers 101, and supports the support frame 41 parallel with the tilting floor 5 in a state in which the spacer body 411 is placed on the drive rollers 101. Due to such a structure, when the respective hydraulic motors 10 are synchronously rotated, the support frame 41, namely, the furnace body 1 that is placed on the drive roller 101 is rotated around a cylinder axis thereof. More durability can be expected from the present structure against the dust environment of a site.

This application is based on Japanese patent application No. 2013-180757 filed Aug. 31, 2013, the entire contents thereof being hereby incorporated by reference.

DESCRIPTION OF REFERENCE NUMERALS AND SIGNS

1: Furnace body
11: Bottom wall
2: Furnace lid
3: Electrode
4: Rotation mechanism
41: Support frame (ring body)
42: Gear body (connecting portion)
5: Tilting floor
6: Tilting body
92: Hydraulic motor (drive mechanism)
93: Gear body (drive mechanism)
95: Gear body (drive mechanism)
961: Sheath member (stopper mechanism)
963: Drive cylinder (stopper mechanism)
964: Plug member (stopper mechanism)

What is claimed is:

1. An arc furnace, comprising:
a furnace body having a bottomed cylindrical shape;
a furnace lid that openably closes an opening of the furnace body;
an electrode that is provided at the furnace lid and melts a metal material supplied into the furnace body by electric discharge;
a tilting floor that is tiltable within a plane substantially perpendicular to the tilting floor; and
a rotator that is provided on the tilting floor inward from an outer circumference of the furnace body to support a bottom wall of the furnace body, and rotates the furnace body around a cylinder axis thereof,
the rotator comprises:
a ring body provided at an outer circumferential portion of a bottom wall of the furnace body,
a connecting portion formed on an inner circumferential surface of the ring body;
a bearing member that is provided at a necessary part of a bottom surface of the ring body to support the ring body rotatably around a center thereof; and
a driver that is provided on the tilting floor inward of the ring body and has an output portion connected to the connecting portion,
the ring body comprises a circular-ring-shaped support frame, and a gear body fixed to a bottom surface of an inner circumferential portion of the support frame,
the connecting portions comprise tooth profiles formed on the entire circumference of the inner circumferential portion of the support frame,
the gear body comprises:
the tooth profiles,
an outer circumferential intermediate portion protruding outward as a rectangular section and providing an inner ring portion of the bearing member, and
an outer ring portion with a U-shaped section wrapping the inner ring portion,
a roller bearing interposed between a concave surface of the outer ring portion, top and bottom surfaces, and an outer peripheral edge surface of the inner ring portion, and
the outer ring portion having a bottom surface fixed to the tilting floor.

2. The arc furnace according to claim 1, further comprising:
a stopper including stopper members provided at a ring body side and a tilting floor side, fitted to each other to restrict rotation of the ring body when the ring body is in a predetermined rotation position.

3. An arc furnace, comprising:
a furnace body having a bottomed cylindrical shape;
a furnace lid that openably closes an opening of the furnace body;
an electrode that is provided at the furnace lid and melts a metal material supplied into the furnace body by electric discharge;
a tilting floor that is tiltable within a plane substantially perpendicular to the tilting floor;
a rotator provided on the tilting floor inward from an outer circumference of the furnace body to support a bottom wall of the furnace body, and rotate the furnace body around a cylinder axis thereof;
the rotator comprising a ring body provided at an outer circumferential portion of a bottom wall of the furnace body, and a circular-ring-shaped support frame, and
a stopper including stopper members provided at a ring body side and a tilting floor side, fitted to each other to restrict rotation of the ring body when the ring body is in a predetermined rotation position,
the stopper members comprising:
a cylindrical sheath provided at the ring body side and including a tapered inner circumference,
a tapered plug provided on the tilting floor side, and
a drive cylinder including a rod connected to a rear end of the tapered plug, the drive cylinder to advance the tapered plug into the cylindrical sheath to restrict rotation of the furnace body.

* * * * *